US009665023B2

(12) United States Patent
Kamae et al.

(10) Patent No.: US 9,665,023 B2
(45) Date of Patent: May 30, 2017

(54) TONER AND TWO-COMPONENT DEVELOPER

(71) Applicant: CANON KABUSHIKI KAISHA, Tokyo (JP)

(72) Inventors: Kentaro Kamae, Kashiwa (JP); Ryuichiro Matsuo, Moriya (JP); Koh Ishigami, Abiko (JP); Masaharu Miura, Toride (JP); Masayuki Hama, Toride (JP); Hiroaki Kawakami, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/566,083

(22) Filed: Dec. 10, 2014

(65) Prior Publication Data

US 2015/0177634 A1 Jun. 25, 2015

(30) Foreign Application Priority Data

Dec. 20, 2013 (JP) ..... 2013-263779

(51) Int. Cl.
*G03G 9/087* (2006.01)
*G03G 9/107* (2006.01)

(52) U.S. Cl.
CPC ..... *G03G 9/08755* (2013.01); *G03G 9/08748* (2013.01); *G03G 9/08793* (2013.01); *G03G 9/08797* (2013.01); *G03G 9/1075* (2013.01)

(58) Field of Classification Search
CPC ..... G03G 9/08755; G03G 9/08748; G03G 9/08753
USPC ..... 430/109.4
See application file for complete search history.

(56) References Cited

U.S. PATENT DOCUMENTS

| | | | | |
|---|---|---|---|---|
| 5,057,392 | A | 10/1991 | McCabe et al. | |
| 5,112,715 | A | 5/1992 | DeMejo et al. | |
| 5,147,747 | A * | 9/1992 | Wilson | C08L 67/00 430/108.2 |
| 5,294,682 | A * | 3/1994 | Fukuda | C08G 63/668 430/109.2 |
| 6,183,927 | B1 | 2/2001 | Magome et al. | |
| 6,569,589 | B2 | 5/2003 | Inaba et al. | |
| 7,135,263 | B2 | 11/2006 | Kawakami et al. | |
| 7,288,348 | B2 | 10/2007 | Hayami et al. | |
| 7,396,626 | B2 | 7/2008 | Fujikawa et al. | |
| 7,629,100 | B2 | 12/2009 | Okamoto et al. | |
| 8,084,174 | B2 | 12/2011 | Hasegawa et al. | |
| 2003/0224278 | A1 * | 12/2003 | Shirai | C08G 63/20 430/109.4 |
| 2006/0024603 | A1 | 2/2006 | Sato | |
| 2008/0227014 | A1 * | 9/2008 | Mizuguchi | G03G 9/0804 430/109.4 |
| 2013/0260297 | A1 | 10/2013 | Sugiura | |

FOREIGN PATENT DOCUMENTS

| | | | |
|---|---|---|---|
| EP | 0 994 395 | A2 | 4/2000 |
| JP | 2000029245 | A * | 1/2000 |
| JP | 2006-39346 | A | 2/2006 |
| JP | 2007-33828 | A | 2/2007 |
| JP | 4047134 | B2 | 2/2008 |

OTHER PUBLICATIONS

Diamond, Arthur S & David Weiss (eds.) Handbook of Imaging Materials, 2nd ed.. New York: Marcel-Dekker, Inc. (Nov. 2001) pp. 178-182.*
Diamond, Arthur S & David Weiss (eds.) Handbook of Imaging Materials, 2nd ed.. New York: Marcel-Dekker, Inc. (Nov. 2001) pp. 145-164.*
English language machine translation of JP 2000-029245 (Jan. 2000).*
European Search Report dated Apr. 23, 2015 in European Application No. 14198518.4.
Mark, "Phenolic Resins", Encyclopedia of Polymer Science and Technology, Third Edition, 2003, vol. 7, pp. 322-367.

* cited by examiner

*Primary Examiner* — Christopher Rodee
(74) *Attorney, Agent, or Firm* — Fitzpatrick, Cella, Harper & Scinto

(57) ABSTRACT

Provided is a toner, including toner particles each containing a binder resin containing a polyester α as a main component, a colorant, a wax, and a crystalline polyester, in which: the polyester α has a polyhydric alcohol unit and a polyvalent carboxylic acid unit; and the polyester α has, as the polyhydric alcohol unit, a polyhydric alcohol unit N derived from an alkylene oxide adduct of a novolac type phenol resin.

6 Claims, No Drawings

TONER AND TWO-COMPONENT DEVELOPER

BACKGROUND OF THE INVENTION

Field of the Invention

The present invention relates to a toner and a two-component developer to be used in an electrophotographic system, an electrostatic recording system, an electrostatic printing system, a toner jet system, or the like.

Description of the Related Art

In recent years, additional improvements in speed and image quality, additional energy savings, and the like have been required in association with the widespread use of a full-color copying machine of an electrophotographic system. A toner that can be fixed at an additionally low fixation temperature in order that power consumption in a fixing step may be reduced has been studied as a specific technology for the energy savings. A toner using a crystalline resin as its softening agent has been studied in order that the toner that can be fixed at low temperature may be realized.

When the crystalline resin is used as a binder resin for the toner, its low-temperature fixability improves but its elasticity at high temperature reduces and hence the so-called hot offset phenomenon in which the toner adheres to a fixing member (such as a fixing roller or a fixing belt) occurs in some cases.

Japanese Patent No. 04047134 proposes a toner that achieves compatibility between its low-temperature fixability and hot offset resistance. When a crosslinking component is produced by using an oxyalkylene ether compound (alkylene oxide adduct) of a novolac type phenol resin, a distance between a crosslinking point and another crosslinking point lengthens (a molecular weight between the crosslinking points increases). In this case, molecular motion by heat easily occurs and a flexible crosslinked body is easily produced. Accordingly, the hot offset resistance can be maintained without any reduction in the low-temperature fixability.

In recent years, multimedia compatibility by virtue of which the toner can be used for various recording materials (media) such as a postcard, small-sized paper, an envelope, cardboard, and label paper has also been required. In view of the foregoing, it has been required to improve the hot offset resistance while maintaining the low-temperature fixability even when any one of the various recording materials is used. This is because a hot offset is liable to occur when a large-sized recording material is passed through a fixing member after a small-sized recording material has been passed therethrough. The reason why the hot offset is liable to occur is as described below. A temperature increase occurs in a portion on the fixing member through which no recording material has passed owing to the passage of the small-sized recording material, and hence the toner on the large-sized recording material to be subsequently passed through the fixing member is excessively heated.

SUMMARY OF THE INVENTION

An object of the present invention is to provide a toner that has solved the problems. Specifically, the object is to provide a toner that has achieved compatibility between excellent low-temperature fixability and excellent hot offset resistance, and a two-component developer including the toner.

According to one embodiment of the present invention, there is provided a toner, including toner particles each containing:

a binder resin containing a polyester α as a main component;

a colorant;

a wax; and a crystalline polyester, in which:

the polyester α has a polyhydric alcohol unit and a polyvalent carboxylic acid unit; and the polyester α has, as the polyhydric alcohol unit, a polyhydric alcohol unit N derived from an alkylene oxide adduct of a novolac type phenol resin.

According to embodiments of the present invention, it is possible to provide the toner that has achieved compatibility between excellent low-temperature fixability and excellent hot offset resistance, and the two-component developer including the toner.

Further features of the present invention will become apparent from the following description of exemplary embodiments.

DESCRIPTION OF THE EMBODIMENTS

Preferred embodiments of the present invention will now be described in detail.

A toner of the present invention includes toner particles each containing:

a binder resin containing a polyester α as a main component;

a colorant;

a wax; and a crystalline polyester, in which:

the polyester α has a polyhydric alcohol unit and a polyvalent carboxylic acid unit; and the polyester α has, as the polyhydric alcohol unit, a polyhydric alcohol unit N derived from an alkylene oxide adduct (oxyalkylene ether) of a novolac type phenol resin.

As described above, when a large-sized recording material is passed through a fixing member after a small-sized recording material has been passed therethrough, a hot offset occurs in some cases.

In view of the foregoing, the inventors of the present invention have made extensive studies and have found that it is important to impart additional releasability to the toner in order that the hot offset may be suppressed. Thus, the inventors have reached the present invention.

The inventors of the present invention have paid attention to the crystalline polyester used as a softening agent for the toner particles. In particular, the crystalline polyester present in a crystalline state in each toner particle has a melting point as in the wax as a release agent, and its viscosity reduces when its temperature becomes equal to or more than the melting point. Thus, the inventors have considered that the crystalline polyester can be caused to exhibit releasability similar to that of the wax.

Accordingly, the inventors of the present invention have found that it is important to provide the crystalline polyester with both the following effects: the effect by which the crystalline polyester is made compatible with the binder resin and caused to serve as a softening agent for the toner particles; and the effect by which the crystalline polyester is caused to exist in a crystalline state in each toner particle and caused to serve as a release agent.

However, in the case where a resin containing the polyester α as a main component is used as a binder resin for the toner particles, when the content of the crystalline polyester in the toner particles is merely increased and the degree of crystallinity of the crystalline polyester is merely increased, its affinity for the binder resin becomes excessively high. As a result, the crystalline polyester hardly exudes from the toner particles at the time of fixation, and hence sufficient releasability is not expressed and sufficient hot offset resistance cannot be obtained.

In view of the foregoing, for controlling the affinity between the binder resin containing the polyester a as a main component and the crystalline polyester, the inventors of the present invention have made extensive studies on the construction of the polyester α as the main component for the binder resin. As a result, the inventors have found that the use of the polyhydric alcohol unit (polyhydric alcohol unit N) derived from the alkylene oxide adduct of the novolac type phenol resin as the polyhydric alcohol unit in the polyester α improves the hot offset resistance of the toner. The inventors of the present invention have observed a fixation interface on an image to find that the presence ratio (area ratio) of a release component (hydrocarbon) has increased. Accordingly, the inventors have considered that the crystalline polyester can easily exude from the toner particles at the time of the fixation.

(Binder Resin)

In the present invention, the resin containing the polyester (polyester α) as a main component is used as the binder resin for the toner particles. The polyester generally has the polyhydric alcohol unit and the polyvalent carboxylic acid unit. The polyhydric alcohol unit is a unit (constituent) derived from a polyhydric alcohol used at the time of the production of the polyester by a condensation polymerization reaction. In addition, the polyvalent carboxylic acid unit is a unit (constituent) derived from a polyvalent carboxylic acid, anhydride thereof, or lower alkyl ester as a derivative thereof used at the time of the production of the polyester by the condensation polymerization reaction.

The polyester α according to the present invention has the polyhydric alcohol unit N as the polyhydric alcohol unit.

The alkylene oxide adduct of the novolac type phenol resin is a reaction product of the novolac type phenol resin and a compound having one epoxy ring in a molecule thereof (epoxide).

An example of the novolac type phenol resin is a novolac type phenol resin produced by subjecting a phenol and an aldehyde to condensation polymerization using as a catalyst an inorganic acid such as hydrochloric acid, phosphoric acid, or sulfuric acid, an organic acid such as p-toluenesulfonic acid or oxalic acid, a metal salt such as zinc acetate, or the like. Those resins are disclosed in ENCYCLOPEDIA OF POLYMER SCIENCE AND TECHNOLOGY (Interscience Publishers), Volume 7, page 322, "PHENOLIC RESINS" section.

Examples of the phenol include phenol and a substituted phenol having one or more hydrocarbon groups each having 1 or more to 35 or less carbon atoms, and/or halogen groups as substituents. Examples of the substituted phenol include cresol (o-cresol, m-cresol, or p-cresol), ethylphenol, nonylphenol, octylphenol, phenylphenol, vinylphenol, isopropenylphenol, 3-chlorophenol, 3-bromophenol, 3,5-xylenol, 2,4-xylenol, 2,6-xylenol, 3,5-dichlorophenol, 2,4-dichlorophenol, 3-chloro-5-methylphenol, dichloroxylenol, dibromoxylenol, 2,4,5-trichlorophenol, and 6-phenyl-2-chlorophenol. Only one kind of those phenols may be used, or two or more kinds thereof may be used in combination. Of those, phenol or a substituted phenol substituted with a hydrocarbon group is preferred. Of those, phenol, cresol, t-butylphenol, or nonylphenol is more preferred. Phenol and cresol are preferred because each of phenol and cresol is inexpensive and improves the offset resistance of the toner, and the substituted phenol substituted with a hydrocarbon group such as t-butylphenol or nonylphenol is preferred because the substituted phenol reduces the temperature dependence of the charge quantity of the toner.

Examples of the aldehyde include formalin (formaldehyde solutions having various concentrations), paraformaldehyde, trioxane, and hexamethylenetetramine.

The number-average molecular weight of the novolac type phenol resin is preferably from 300 or more to 8,000 or less, more preferably from 450 or more to 3,000 or less, still more preferably from 500 or more to 1,000 or less.

The number-average nucleus number of the phenols in the novolac type phenol resin is preferably from 3 or more to 60 or less, more preferably from 3 or more to 20 or less, still more preferably from 4 or more to 15 or less.

In addition, the softening point (JIS K2531: ring and ball method) of the novolac type phenol resin is preferably from 40° C. or more to 180° C. or less, more preferably from 40° C. or more to 150° C. or less, still more preferably from 50° C. or more to 130° C. or less. When the softening point is 40° C. or more, the resin is easy to handle because its blocking hardly occurs at normal temperature. When the softening point is 180° C. or less, the gelation of the resin is hardly caused in a production process for the polyester α.

Specific examples of the compound having one epoxy ring in a molecule thereof include ethylene oxide (EO), 1,2-propylene oxide (PO), 1,2-butylene oxide, 2,3-butylene oxide, styrene oxide, and epichlorohydrin as well as an aliphatic monohydric alcohol having 1 or more to 20 or less carbon atoms and a glycidyl ether of a monohydric phenol. Of those, EO or PO is preferred.

The addition number of moles of the compound having one epoxy ring in a molecule thereof with respect to 1 mol of the novolac type phenol resin is preferably from 1 mol or more to 30 mol or less, more preferably from 2 mol or more to 15 mol or less, still more preferably from 2.5 mol or more to 10 mol or less.

The average addition number of moles of the compound having one epoxy ring in a molecule thereof with respect to one phenolic hydroxy group in the novolac type phenol resin is preferably from 0.1 mol or more to 10 mol or less, more preferably from 0.1 mol or more to 4 mol or less, still more preferably from 0.2 mol or more to 2 mol or less.

An example of the structure of the alkylene oxide adduct of the novolac type phenol resin to be preferably used in the present invention is given below.

(N)

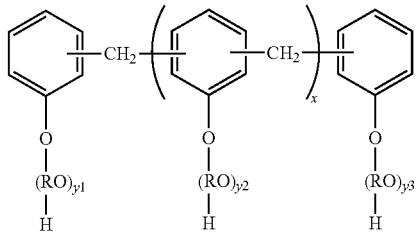

In the formula (N), R's each independently represent an ethylene group or a propylene group, x represents a number of 0 or more, and y1 to y3 each independently represent a number of 0 or more. That is, y1 to y3 may represent the same number or may represent different numbers.

The number-average molecular weight of the alkylene oxide adduct of the novolac type phenol resin is preferably from 300 or more to 10,000 or less, more preferably from 350 or more to 5,000 or less, still more preferably from 450 or more to 3,000 or less. When the number-average molecular weight is 300 or more, a hot offset hardly occurs, and when the number-average molecular weight is 10,000 or less, the gelation is hardly caused in the production process for the polyester α.

The hydroxyl value (total of an alcoholic hydroxy group and a phenolic hydroxy group) of the alkylene oxide adduct of the novolac type phenol resin is preferably from 10 mgKOH/g or more to 550 mgKOH/g or less, more preferably from 50 mgKOH/g or more to 500 mgKOH/g or less, still more preferably from 100 mgKOH/g or more to 450 mgKOH/g or less. In addition, a phenolic hydroxyl value out of the hydroxyl value is preferably from 0 mgKOH/g or more to 500 mgKOH/g or less, more preferably from 0 mgKOH/g or more to 350 mgKOH/g or less, still more preferably from 5 mgKOH/g or more to 250 mgKOH/g or less.

An example of a method of producing the alkylene oxide adduct of the novolac type phenol resin is given below.

The alkylene oxide adduct of the novolac type phenol resin is obtained by subjecting the novolac type phenol resin and the compound having one epoxy ring in a molecule thereof to an addition reaction in the presence of a catalyst (a basic catalyst or an acid catalyst) as required. The temperature at which the reaction is performed is preferably from 20° C. or more to 250° C. or less, more preferably from 70° C. or more to 200° C. or less. The addition reaction can be performed under normal pressure, under pressure, or under reduced pressure. In addition, the addition reaction can be performed in the presence of, for example, a solvent such as xylene or dimethylformamide, or any other dihydric alcohol and/or any other alcohol that is trihydric or more.

In addition to the alkylene oxide adduct of the novolac type phenol resin, for example, any one of the following polyhydric alcohol components can be used as a component for constituting the polyhydric alcohol unit of the polyester α as required.

As a dihydric alcohol component, there are given, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and hydrogenated bisphenol A as well as a diol (bisphenol or a derivative thereof) represented by the following formula (A):

(A)

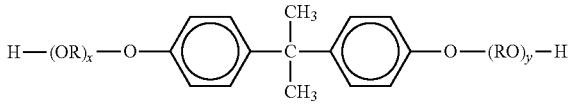

(in the formula (A), R represents an ethylene group or a propylene group, x and y each independently represent an integer of 0 or more, and the average of x+y is from 0 or more to 10 or less)

and a diol represented by the following formula (B):

(B)

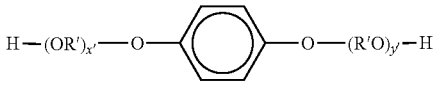

(in the formula (B), R' represents

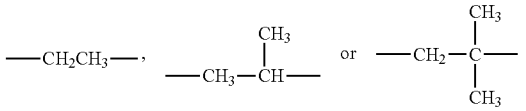

x' and y' each independently represent an integer of 0 or more, and the average of x'+y' is from 0 or more to 10 or less.)

The polyester α according to the present invention preferably has 0.1 mol % or more to 3.0 mol % or less of the polyhydric alcohol unit N with respect to the total number of moles of the polyhydric alcohol units from the viewpoint of the hot offset resistance.

A component for constituting the polyvalent carboxylic acid unit of the polyester resin is, for example, an aromatic dicarboxylic acid or a derivative thereof.

The polyester α according to the present invention preferably contains, as the main chain of the polyvalent carboxylic acid unit, a straight-chain (long-chain) hydrocarbon having 4 or more to 16 or less carbon atoms. In addition, the polyester α preferably has a polyvalent carboxylic acid unit (polyvalent carboxylic acid unit F) derived from an aliphatic dicarboxylic acid having carboxy groups bonded to both terminals of the main chain. The polyvalent carboxylic acid unit F in each toner particle serves as a crystal nucleating agent for the crystalline polyester and hence makes it easy for the crystalline polyester in the toner particle to exist in a crystalline state. Accordingly, the hot offset resistance improves and the storage stability of the toner also improves.

Examples of the aliphatic dicarboxylic acid containing the straight-chain hydrocarbon having 4 or more to 16 or less carbon atoms as its main chain, and having carboxy groups bonded to both terminals of the main chain include adipic acid, azelaic acid, sebacic acid, tetradecanedioic acid, and octadecanedioic acid. Those acids are alkyl dicarboxylic acids. In addition, the examples include anhydrides thereof and lower alkyl esters as derivatives thereof. In addition, the examples include compounds having structures obtained by branching part of the main chains of the acids with alkyl groups such as a methyl group, an ethyl group, and an octyl group, and alkylene groups. The number of carbon atoms of the straight-chain hydrocarbon is preferably from 4 or more to 12 or less.

Examples of a polyvalent carboxylic acid unit except the polyvalent carboxylic acid unit F to be incorporated into the polyester α include: aromatic dicarboxylic acids such as phthalic acid, isophthalic acid, and terephthalic acid, and anhydrides thereof; succinic acid substituted with an alkyl group or alkenyl group having 6 or more to 18 or less carbon atoms, and an anhydride thereof; and unsaturated dicarboxylic acids such as fumaric acid, maleic acid, and citraconic acid, and anhydrides thereof. Of those, from the viewpoint of the hot offset resistance, preferred is a carboxylic acid having an aromatic ring or a derivative thereof such as terephthalic acid, isophthalic acid, trimellitic acid, pyromellitic acid, benzophenonetetracarboxylic acid, or an anhydride thereof.

In addition, the polyester α preferably has 5.0 mol % or more to 15.0 mol % or less of the polyvalent carboxylic acid unit F with respect to the total number of moles of the polyvalent carboxylic acid units from the viewpoint of compatibility between the hot offset resistance and low-temperature fixability of the toner. Setting the content to from 5.0 mol % or more to 15.0 mol % or less optimally controls the crystallization of the crystalline polyester in each toner particle and its compatibility with the binder resin, and achieves an additionally high level of compatibility between the hot offset resistance and the low-temperature fixability.

The binder resin to be contained in each toner particle may be a hybrid resin having any other resin component in combination as long as the resin contains the polyester α as a main component. The hybrid resin is, for example, a hybrid resin of the polyester α and a vinyl-based polymer. A method of obtaining the hybrid resin is, for example, a method involving performing, in the presence of a polymer containing a monomer component capable of reacting with each of the vinyl-based polymer and the polyester α, the polymerization reaction of one or both of the polymers.

Examples of the monomer capable of reacting with the vinyl-based polymer in monomers that may constitute the polyester α include unsaturated dicarboxylic acids such as phthalic acid, maleic acid, citraconic acid, and itaconic acid and anhydrides thereof.

Examples of the monomer capable of reacting with the polyester α in monomers that may constitute the vinyl-based polymer include a monomer having a carboxy group or a hydroxy group, an acrylic acid ester, and a methacrylic acid ester.

In addition, as the binder resin to be contained in the toner particle, any other resin may be used in combination as long as the binder resin contains the polyester α as a main component. Examples of such other resin include a phenol resin, a natural resin-modified phenol resin, a natural resin-modified maleic resin, an acrylic resin, a methacrylic resin, a polyvinyl acetate resin, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

In addition, a low-molecular weight binder resin A and a high-molecular weight binder resin B are preferably incorporated as the binder resins of each toner particle from the viewpoint of the compatibility between the hot offset resistance and the low-temperature fixability.

The ratio (A/B) of the low-molecular weight binder resin A to the high-molecular weight binder resin B is preferably from 10/90 or more to 60/40 or less on a mass basis from the viewpoint of the compatibility between the hot offset resistance and the low-temperature fixability.

The peak molecular weight of the high-molecular weight binder resin is preferably from 10,000 or more to 20,000 or less from the viewpoint of the hot offset resistance. In addition, the acid value of the high-molecular weight binder resin is preferably from 15 mgKOH/g or more to 30 mgKOH/g or less from the viewpoint of the charging stability of the toner under a high-temperature and high-humidity environment.

The number-average molecular weight of the low-molecular weight binder resin is preferably from 1,500 or more to 3,500 or less from the viewpoint of the low-temperature fixability. In addition, the acid value of the low-molecular weight binder resin is preferably 10 mgKOH/g or less from the viewpoint of the charging stability under a high-temperature and high-humidity environment.

(Wax (Release Agent))

The toner particles of the toner of the present invention each contain the wax. The wax can serve as a release agent.

Examples of the wax include: a hydrocarbon-based wax such as low-molecular-weight polyethylene, low-molecular-weight polypropylene, an alkylene copolymer, microcrystalline wax, paraffin wax, or Fischer-Tropsch wax; an oxide of a hydrocarbon-based wax such as oxidized polyethylene wax or a block copolymerization product thereof; a wax containing a fatty acid ester as a main component, such as carnauba wax; a wax obtained by subjecting part or all of a fatty acid ester to deoxidization such as deoxidized carnauba wax; a saturated straight-chain fatty acid such as palmitic acid, stearic acid, or montanic acid; a unsaturated fatty acid such as brassidic acid, eleostearic acid, or parinaric acid; a saturated alcohol such as stearyl alcohol, aralkyl alcohol, behenyl alcohol, carnaubyl alcohol, ceryl alcohol, or melissyl alcohol; a polyhydric alcohol such as sorbitol; an ester formed of a fatty acid such as palmitic acid, stearic acid, behenic acid, or montanic acid, and an alcohol such as stearyl alcohol, aralkyl alcohol, behenyl alcohol, carnaubyl alcohol, ceryl alcohol, or melissyl alcohol; a fatty acid amide such as linoleamide, oleamide, or lauramide; a saturated fatty acid bisamide such as methylenebisstearamide, ethylenebiscapramide, ethylenebislauramide, or hexamethylenebisstearamide; an unsaturated fatty acid amide such as ethylenebisoleamide, hexamethylenebisoleamide, N,N'-dioleyladipamide, or N,N'-dioleylsebacamide; an aromatic bisamide such as m-xylenebisstearamide or N,N'-distearylisophthalamide; an aliphatic metal salt such as calcium stearate, calcium laurate, zinc stearate, or magnesium stearate (generally referred to as metal soap); a wax obtained by grafting an aliphatic hydrocarbon-based wax with a vinyl-based monomer such as styrene or acrylic acid; a partially esterified product formed of a fatty acid such as behenic acid monoglyceride and a polyhydric alcohol; and a methyl ester compound having a hydroxy group obtained by subjecting a vegetable oil and fat to hydrogenation.

Of those waxes, a hydrocarbon-based wax such as paraffin wax or Fischer-Tropsch wax, or a fatty acid ester-based wax such as carnauba wax is preferred from the viewpoint of the compatibility between the low-temperature fixability and the hot offset resistance. Of those, a hydrocarbon-based wax is more preferred from the viewpoint of the hot offset resistance.

The content of the wax in the toner particles is preferably from 1 part by mass or more to 20 parts by mass or less with respect to 100 parts by mass of the binder resin in the toner particles.

In addition, the peak temperature of the highest endothermic peak of the wax in an endothermic curve at the time of temperature increase measured with a differential scanning calorimeter (DSC) is preferably from 45° C. or more to 140° C. or less from the viewpoint of the compatibility between the hot offset resistance and the low-temperature fixability.

(Colorant)

Examples of the colorant to be used in each toner particle of the toner of the present invention include the following colorants.

A black colorant is, for example, carbon black or a colorant toned to a black color with a yellow colorant, a magenta colorant, and a cyan colorant.

As a magenta pigment among the magenta colorants, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a magenta dye among the magenta colorants, there are given, for example: oil-soluble dyes such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a cyan pigment among the cyan colorants, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted with 1 or more to 5 or less phthalimidomethyl groups.

For example, C.I. Solvent Blue 70 is given as a cyan dye among the cyan colorants.

As a yellow pigment among the yellow colorants, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

For example, C.I. Solvent Yellow 162 is given as a dye for yellow toner among the yellow colorants.

A pigment may be used alone as the colorant, but from the viewpoint of the image quality of a full-color image, the pigment and a dye are more preferably used in combination to improve its sharpness.

The content of the colorant in the toner particles is preferably from 0.1 part by mass or more to 30 parts by mass or less with respect to 100 parts by mass of the binder resin in the toner particles.

(Charge Control Agent)

A charge control agent may be incorporated into each toner particle as required.

The charge control agent is, for example, a metal compound of an aromatic carboxylic acid. The metal compound of the aromatic carboxylic acid is a preferred charge control agent because the compound is colorless, increases the speed at which the toner is charged, and stably holds a constant charge quantity with ease.

As a negative charge control agent, there are given, for example, a metal salicylate compound, a metal naphthoate compound, and a metal dicarboxylate compound. There are also given, for example, a polymeric compound having a sulfonic acid or a carboxylic acid in a side chain, a polymeric compound having a sulfonic acid salt or a sulfonic acid ester in a side chain, and a polymeric compound having a carboxylic acid salt or a carboxylic acid ester in a side chain. There are also given, for example, a boron compound, a urea compound, a silicon compound, and a calixarene.

As a positive charge control agent, there are given, for example, a quaternary ammonium salt, a polymeric compound having a quaternary ammonium salt in a side chain, a guanidine compound, and an imidazole compound.

The charge control agent may be internally added to each toner particle or may be externally added to the toner particle.

The content of the charge control agent in the toner particles is preferably from 0.2 part by mass or more to 10 parts by mass or less with respect to 100 parts by mass of the binder resin in the toner particles.

(Crystalline Polyester)

The toner particles of the toner of the present invention each contain the crystalline polyester. The crystalline polyester can serve as a softening agent for the toner particles.

In the toner of the present invention, the crystalline polyester in each toner particle is preferably a polyester obtained by subjecting a monomer composition containing the following components as main components to a condensation polymerization reaction:

an aliphatic diol having 2 or more to 22 or less carbon atoms as an alcohol component; and an aliphatic dicarboxylic acid having 2 or more to 22 or less carbon atoms as an acid component.

The aliphatic diol having 2 or more to 22 or less carbon atoms (more preferably 2 or more to 12 or less carbon atoms) is preferably a chain (more preferably straight-chain) aliphatic diol.

Examples of the chain aliphatic diol include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. Of those, a straight-chain aliphatic diol such as ethylene glycol, diethylene glycol, 1,4-butanediol, or 1,6-hexanediol or an $\alpha,\omega$-diol is preferred.

The aliphatic diol having 2 or more to 22 or less carbon atoms accounts for preferably 50 mass % or more, more preferably 70 mass % or more of the alcohol component in the monomer composition.

In the present invention, a polyhydric alcohol monomer except the aliphatic diol can also be used in the synthesis of the crystalline polyester.

As a dihydric alcohol monomer out of the polyhydric alcohol monomers except the aliphatic diol, there are given, for example: an aromatic alcohol such as polyoxyethylenated bisphenol A or polyoxypropylenated bisphenol A; and 1,4-cyclohexanedimethanol.

In addition, as a trihydric or more polyhydric alcohol monomer out of the polyhydric alcohol monomers except the aliphatic diol, there are given, for example: an aromatic alcohol such as 1,3,5-trihydroxymethylbenzene; and an aliphatic alcohol such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, or trimethylolpropane.

In the present invention, a monohydric alcohol monomer may be used in combination in the synthesis of the crystalline polyester. Examples of the monohydric alcohol include n-butanol, isobutanol, sec-butanol, n-hexanol, n-octanol, lauryl alcohol, 2-ethylhexanol, decanol, cyclohexanol, benzyl alcohol, and dodecyl alcohol.

The aliphatic dicarboxylic acid having 2 or more to 22 or less carbon atoms (more preferably 4 or more to 14 or less carbon atoms) is preferably a chain (more preferably straight-chain) aliphatic dicarboxylic acid.

Examples of the chain aliphatic dicarboxylic acid include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid. A product obtained by, for example, hydrolyzing an acid anhydride or lower alkyl ester thereof can also be used.

The aliphatic dicarboxylic acid having 2 or more to 22 or less carbon atoms accounts for preferably 50 mass % or more, more preferably 70 mass % or more of the acid component in the monomer composition.

In the present invention, a polyvalent carboxylic acid except the aliphatic dicarboxylic acid can also be used in the synthesis of the crystalline polyester.

As a divalent carboxylic acid out of the polyvalent carboxylic acid monomers except the aliphatic dicarboxylic acid, there are given, for example: an aromatic carboxylic acid such as isophthalic acid or terephthalic acid; an aliphatic carboxylic acid such as n-dodecylsuccinic acid or n-dodecenylsuccinic acid; and an alicyclic carboxylic acid such as cyclohexanedicarboxylic acid. In addition, for example, an acid anhydride or lower alkyl ester thereof may also be used.

In addition, as a trivalent or more polyvalent carboxylic acid out of the polyvalent carboxylic acid monomers except the aliphatic dicarboxylic acid, there are given, for example: an aromatic carboxylic acid such as 1,2,4-benzenetricarboxylic acid (trimellitic acid), 2,5,7-naphthalenetricarboxylic acid, 1,2,4-naphthalenetricarboxylic acid, or pyromellitic acid; and an aliphatic carboxylic acid such as 1,2,4-butanetricarboxylic acid, 1,2,5-hexanetricarboxylic acid, or 1,3-dicarboxy-2-methyl-2-methylenecarboxypropane. In addition, for example, an acid anhydride or lower alkyl ester thereof may also be used.

In the present invention, a monovalent carboxylic acid monomer may be used in combination in the synthesis of the crystalline polyester. Examples of the monovalent carboxylic acid include benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid.

The crystalline polyester to be used in the present invention can be synthesized in accordance with an ordinary polyester synthesis method. For example, the crystalline polyester can be synthesized by: subjecting the carboxylic acid monomer and the alcohol monomer to an esterification reaction or an ester exchange reaction; and subjecting the resultant to a condensation polymerization reaction in accordance with an ordinary method under reduced pressure or while introducing a nitrogen gas.

The esterification or ester exchange may be performed using a general esterification catalyst or ester exchange catalyst such as sulfuric acid, titanium butoxide, dibutyltin oxide, manganese acetate, or magnesium acetate as required.

In addition, the condensation polymerization reaction may be performed using a polymerization catalyst. Examples of the polymerization catalyst include titanium butoxide, dibutyltin oxide, tin acetate, zinc acetate, tin disulfide, antimony trioxide, and germanium dioxide.

In the esterification or ester exchange reaction, or the condensation polymerization reaction, all monomers can be collectively loaded in order that the strength of the crystalline polyester to be obtained may be improved. In addition, the following procedure can be adopted in order that the amount of a low-molecular weight component in the crystalline polyester to be obtained may be reduced: a divalent monomer is subjected to a reaction before a monomer that is trivalent or more is additionally subjected to a reaction.

(Inorganic Fine Particles)

Inorganic fine particles may be incorporated into the toner particles of the toner of the present invention as required.

The inorganic fine particles may be internally added to the toner particles or may be mixed as an external additive with the toner particles.

Examples of the inorganic fine particles to be used as the external additive include silica, titanium oxide (titania), and aluminum oxide (alumina).

It is preferred that the inorganic fine particles be hydrophobized with a hydrophobizing agent such as a silane compound, silicone oil, or a mixture thereof.

An external additive for improving the flowability of the toner is preferably inorganic fine particles having a specific surface area of from 50 $m^2/g$ or more to 400 $m^2/g$ or less. An external additive for improving the durability of, or stabilizing, the toner is preferably inorganic fine particles having a specific surface area of from 10 $m^2/g$ or more to 50 $m^2/g$ or less. A plurality of kinds of inorganic fine particles whose specific surface areas fall within the ranges may be used in combination in order that compatibility between an improvement in the flowability and an improvement in the durability or the stabilization may be achieved.

The content of the external additive in the toner is preferably from 0.1 part by mass or more to 10.0 parts by mass or less with respect to 100 parts by mass of the toner particles. The toner particles and the external additive can be mixed with a mixer such as a Henschel mixer.

(Developer)

The toner of the present invention can be used as a one-component system developer and can also be used as a toner for a two-component developer. The toner is preferably mixed with a magnetic carrier and used as a toner for a two-component developer in order that dot reproducibility may be improved and a stable image may be obtained over a long time period.

Examples of the magnetic carrier include: iron powder whose surface is oxidized; unoxidized iron powder; particles of metals such as iron, lithium, calcium, magnesium, nickel, copper, zinc, cobalt, manganese, chromium, and rare earths, particles of alloys thereof, and particles of oxides thereof; magnetic materials such as ferrites; and a magnetic material-dispersed resin carrier (so-called resin carrier) containing a magnetic material and a binder resin holding the magnetic material in a dispersed state.

When the toner of the present invention and the magnetic carrier are mixed to be used as a two-component developer, the content (concentration) of the toner in the two-component developer is preferably from 2 mass % or more to 15 mass % or less, more preferably from 4 mass % or more to 13 mass % or less with respect to the total mass of the two-component developer.

(Production Method)

A method of producing the toner particles is, for example, a pulverization method involving: melt-kneading the binder resin, the wax (release agent), the colorant, and the crystalline polyester; cooling the resultant kneaded product; and pulverizing and classifying the cooled product.

Now, a production process for the toner particles based on the pulverization method is described.

In a raw material-mixing step, predetermined amounts of materials constituting the toner particles, e.g., the binder resin, the wax (release agent), the colorant, and the crystalline polyester, and as required, other components such as the charge control agent are weighed, and the materials are blended and mixed. As a mixing apparatus, there are given, for example, a double cone mixer, a V-type mixer, a drum type mixer, a super mixer, a Henschel mixer, a Nauta mixer, and MECHANO HYBRID (manufactured by NIPPON COKE & ENGINEERING CO., LTD.).

Next, the mixed materials are melt-kneaded to disperse the wax and the like in the binder resin. As a kneader to be used in the melt-kneading step, there are given, for example, a batch kneader such as a pressurizing kneader or a Banbury mixer, and a continuous kneader. A single-screw or a twin-screw extruder is preferred because of advantages of continuous production. Examples of the kneader include: a twin-screw extruder model KTK (manufactured by Kobe Steel., Ltd.); a twin-screw extruder model TEM (manufactured by Toshiba Machine CO., Ltd.); a twin-screw extruder (manufactured by KCK CO., Ltd.); a PCM kneader (manufactured by Ikegai Corp.); a co-kneader (manufactured by Buss Inc.); and KNEADEX (NIPPON COKE & ENGINEERING CO., LTD.). A kneaded product (resin composition) obtained by the melt-kneading may be rolled by a twin roll or the like, and cooled with water or the like in a cooling step.

Next, the cooled product of the kneaded product (resin composition) is pulverized to a desired particle diameter in a pulverizing step. In the pulverizing step, first, the cooled product is coarsely pulverized with a pulverizer such as a crusher, a hammer mill, or a feather mill. After that, the resultant is finely pulverized with, for example, Kryptron System (manufactured by Kawasaki Heavy Industries, Ltd.), Super Rotor (manufactured by Nisshin Engineering Inc.), Turbo Mill (manufactured by FREUND-TURBO CORPORATION), or a fine pulverizer based on an air-jet system.

After that, as required, the resultant particles are classified with, for example, an inertial classification type classifier or siever such as Elbow-Jet (manufactured by NITTETSU MINING CO., LTD), or a centrifugal type classifier or siever such as Turboplex (manufactured by Hosokawa Micron Corporation), TSP Separator (manufactured by Hosokawa Micron Corporation), or Faculty (manufactured by Hosokawa Micron Corporation) to obtain a classified product (toner particles). Of those, Faculty (manufactured by Hosokawa Micron Corporation) can perform spheroidization treatment for the toner particles as well as classification. Toner particles subjected to the spheroidization treatment are preferred from the viewpoint of transfer efficiency.

An external additive is externally added to the surface of each toner particle as required. A method of externally adding the external additive is, for example, a method involving: mixing classified toner particles and the external additive; and stirring and mixing the contents with an external addition machine. Examples of the external addition machine include mixing apparatus such as a double cone mixer, a V-type mixer, a drum type mixer, a super mixer, a Henschel mixer, a Nauta mixer, MECHANO HYBRID (manufactured by NIPPON COKE & ENGINEERING CO., LTD.), and NOBILTA (manufactured by Hosokawa Micro Corporation).

Methods of measuring the physical properties of the toner and raw materials therefor are described below.

(Measurement of Molecular Weight of Resin by GPC)

The molecular weight distribution of the tetrahydrofuran (THF) soluble matter of the resin is measured by gel permeation chromatography (GPC) as described below.

First, the toner is dissolved in THF at room temperature over 24 hours. Then, the resultant solution is filtered with a solvent-resistant membrane filter "Myshoridisk" (manufactured by TOSOH CORPORATION) having a pore diameter of 0.2 μm to provide a sample solution. It should be noted that the concentration of a THF-soluble component in the sample solution is adjusted to 0.8 mass %. Measurement is performed with the sample solution under the following conditions.

Apparatus: HLC 8120 GPC (detector: RI) (manufactured by TOSOH CORPORATION)
Column: Septuplicate of Shodex KF-801, 802, 803, 804, 805, 806, and 807 (manufactured by Showa Denko K. K.)
Eluent: tetrahydrofuran (THF)
Flow rate: 1.0 mL/min
Oven temperature: 40.0° C.
Sample injection amount: 0.10 mL In the calculation of the molecular weight of the sample, a molecular weight calibration curve prepared with standard polystyrene resins is used. Examples of the standard polystyrene resins include product names "TSK standard polystyrenes F-850, F-450, F-288, F-128, F-80, F-40, F-20, F-10, F-4, F-2, F-1, A-5000, A-2500, A-1000, and A-500" (manufactured by Tosoh Corporation).

(Method of Measuring Softening Point of Resin)

The softening point of the resin is measured through use of a constant-pressure extrusion system capillary rheometer "flow characteristic-evaluating apparatus Flow Tester CFT-500D" (manufactured by Shimadzu Corporation) in accordance with the manual attached to the apparatus. In this apparatus, a measurement sample filled in a cylinder is increased in temperature to be melted while a predetermined load is applied to the measurement sample with a piston from above, and the melted measurement sample is extruded from a die in a bottom part of the cylinder. At this time, a flow curve representing a relationship between a piston descent amount and the temperature can be obtained.

In the present invention, a "melting temperature in a ½ method" described in the manual attached to the "flow characteristic-evaluating apparatus Flow Tester CFT-500D" is defined as a softening point. It should be noted that the melting temperature in the ½ method is calculated as described below. First, ½ of a difference between a descent amount Smax of the piston at a time when the outflow is finished and a descent amount Smin of the piston at a time when the outflow is started is determined (The ½ of the difference is defined as X. X=(Smax−Smin)/2). Then, the temperature in the flow curve when the descent amount of the piston reaches X in the flow curve is the melting temperature in the ½ method.

The measurement sample is obtained by subjecting 1.0 g of the resin to compression molding for 60 seconds under 10 MPa through use of a tablet compressing machine (for example, NT-100H, manufactured by NPa SYSTEM Co., Ltd.) under an environment of 25° C. to form the resin into a cylindrical shape having a diameter of 8 mm.

The measurement conditions of the CFT-500D are as described below.

Test mode: heating method
Starting temperature: 50° C.
Reached temperature: 200° C.
Measurement interval: 1.0° C.
Rate of temperature increase: 4° C./min
Piston sectional area: 1.000 $cm^2$
Test load (piston load): 10.0 kgf (0.9807 MPa)
Preheating time: 300 seconds
Diameter of hole of die: 1.0 mm
Length of die: 1.0 mm (Measurement of Glass Transition Temperature (Tg) of Resin)

The glass transition temperature of the resin is measured with a differential scanning calorimeter "Q1000" (manufactured by TA Instruments) in conformity with ASTM D3418-82.

The melting points of indium and zinc are used for the temperature correction of the detecting portion of the apparatus, and the heat of fusion of indium is used for the correction of a heat quantity.

Specifically, 5 mg of the resin are precisely weighed and loaded into a pan made of aluminum, and then measurement is performed by using an empty pan made of aluminum as a reference in the measuring range of from 30° C. or more to 200° C. or less at a rate of temperature increase of 10° C./min. The temperature of the resin is increased to 180° C. once and held at the temperature for 10 minutes. Subsequently, the temperature is reduced to 30° C. and then increased again. In the second temperature increase process, a change in specific heat is obtained in the temperature range of from 30° C. or more to 100° C. or less. The point of intersection of a line, which connects the midpoints of baselines before and after the appearance of the change in specific heat, and a differential thermal curve at this time is defined as the glass transition temperature (Tg) of the resin.

(Method of Measuring Weight-Average Particle Diameter (D4) of Toner Particles)

The weight-average particle diameter (D4) of the toner particles is measured with the number of effective measurement channels of 25,000 by using a precision particle size distribution-measuring apparatus based on a pore electrical resistance method provided with a 100-μm aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data. Then, the measurement data is analyzed to calculate the diameter.

An electrolyte aqueous solution prepared by, for example, dissolving guaranteed sodium chloride in ion-exchanged water so as to have a concentration of 1 mass % can be used in the measurement. An example of such electrolyte aqueous solution is "ISOTON II" (manufactured by Beckman Coulter, Inc.).

It should be noted that the dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to "ISOTON II", and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of from 2 μm or more to 60 μm or less.

A specific measurement method is as described below.

(1) 200 mL of the electrolyte aqueous solution are charged into a 250-mL round-bottom beaker made of glass dedicated for the Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the analytical software.

(2) 30 mL of the electrolyte aqueous solution are charged into a 100-mL flat-bottom beaker made of glass. 0.3 mL of a diluted solution prepared by diluting "Contaminon N" (a 10-mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispension System Tetora 150" (manufactured by Nikkaki Bios Co., Ltd.) having an electrical output of 120 W. 2 mL of the "Contaminon N" are charged into the water tank. In the ultrasonic dispersing unit, two oscillators each having an oscillatory frequency of 50 kHz are built so as to be out of phase by 180°.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) 10 mg of toner are gradually added to and dispersed in the electrolyte aqueous solution in the beaker in the section (4) in a state in which the electrolyte aqueous solution is irradiated with the ultrasonic wave. Then, the ultrasonic dispersion treatment is continued for an additional 60 seconds. It should be noted that the temperature of water in the water tank is adjusted so as to be from 10° C. or more to 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to 5%. Then, measurement is performed until the particle diameters of 50,000 particles are measured.

(7) The measurement data is analyzed with the dedicated software included with the apparatus, and the weight-average particle diameter (D4) is calculated. It should be noted that an "average diameter" on the "analysis/volume statistics (arithmetic average)" screen of the dedicated software when the dedicated software is set to show a graph in a vol % unit is the weight-average particle diameter (D4).

EXAMPLES

Production Example of High-Molecular Weight Binder Resin A1

Polyoxypropylene(2.2)-2,2-bis(4-hydroxyphenyl)propane: 68.2 parts by mass (0.19 mol: 97.0 mol % with respect to the total number of moles of polyhydric alcohols)

Novolac type phenol resin (adduct with 5 mol of ethylene oxide having a nucleus number of about 5): 4.4 parts by mass (0.01 mol: 3.0 mol % with respect to the total number of moles of the polyhydric alcohols)

Terephthalic acid: 15.0 parts by mass (0.09 mol: 55.0 mol % with respect to the total number of moles of polyvalent carboxylic acids)

Adipic acid: 6.0 parts by mass (0.04 mol: 25.0 mol % with respect to the total number of moles of the polyvalent carboxylic acids)

Titanium tetrabutoxide (esterification catalyst): 0.5 part by mass

The above-mentioned materials were weighed and loaded into a reaction vessel provided with a cooling tube, a stirring machine, a nitrogen-introducing tube, and a thermocouple. Next, the inside of the reaction vessel was replaced with a nitrogen gas, and then a temperature in the reaction vessel was gradually increased while the materials were stirred.

The materials were subjected to a reaction for 2 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure (first reaction step).

Trimellitic anhydride: 6.4 parts by mass (0.03 mol: 20.0 mol % with respect to the total number of moles of the polyvalent carboxylic acids)

Tert-butylcatechol (polymerization inhibitor): 0.1 part by mass

After that, the above-mentioned materials were added to the resultant, the pressure in the reaction vessel was reduced to 8.3 kPa, and the mixture was subjected to a reaction for 15 hours while the temperature was maintained at 160° C. Then, it was confirmed that a softening point measured in accordance with ASTM D36-86 reached a temperature shown in Table 1. After that, the reaction was stopped by reducing the temperature (second reaction step). Thus, a binder resin A1 was obtained. Table 1 shows the peak molecular weight, softening point, and glass transition temperature of the resultant binder resin A1.

Production Examples of High-Molecular Weight Binder Resins A2 to A14

In the production example of the binder resin A1, the amount of each monomer was changed so that the molar fractions of the polyhydric alcohol components and/or the polyvalent carboxylic acid components reached values shown in Table 1, and a time period for the second reaction was changed so that the softening point reached a value shown in Table 1. Binder resins A2 to A14 were each obtained by performing a reaction in the same manner as in the production example of the binder resin A1 except the foregoing. Table 1 shows the physical properties of the binder resins A2 to A14.

Production Example of High-Molecular Weight Binder Resin 15

Polyoxypropylene(2.2)-2,2-bis(4-hydroxyphenyl)propane: 47.1 parts by mass (0.13 mol: 90.0 mol % with respect to the total number of moles of polyhydric alcohols)

Novolac type phenol resin (adduct with 5 mol of propylene oxide having a nucleus number of about 5): 11.9 parts by mass (0.01 mol: 10.0 mol % with respect to the total number of moles of the polyhydric alcohols)

Terephthalic acid: 16.3 parts by mass (0.10 mol: 80.0 mol % with respect to the total number of moles of polyvalent carboxylic acids)

Titanium tetrabutoxide (esterification catalyst): 0.5 part by mass

The above-mentioned materials were weighed and loaded into a reaction vessel provided with a cooling tube, a stirring machine, a nitrogen-introducing tube, and a thermocouple. Next, the inside of the reaction vessel was replaced with a nitrogen gas, and then a temperature in the reaction vessel was gradually increased while the materials were stirred. The materials were subjected to a reaction for 2 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure (first reaction step).

Acrylic acid: 0.5 part by mass

Styrene: 16.4 parts by mass

2-Ethylhexyl acrylate: 3.1 parts by mass

Dibutyl peroxide (polymerization initiator): 1.5 parts by mass

After that, the above-mentioned mixture was dropped over 1 hour through a dropping funnel and the resultant was left to stand for 1 hour (StAc conversion reaction step).

Trimellitic anhydride: 6.4 parts by mass (0.03 mol: 20.0 mol % with respect to the total number of moles of the polyvalent carboxylic acids)

Tert-butylcatechol (polymerization inhibitor): 0.1 part by mass

After that, the above-mentioned materials were added to the resultant, the pressure in the reaction vessel was reduced to 8.3 kPa, and the mixture was subjected to a reaction for 15 hours while the temperature was maintained at 160° C. Then, it was confirmed that a softening point measured in accordance with ASTM D36-86 reached a temperature shown in Table 1. After that, the reaction was stopped by reducing the temperature (second reaction step). Thus, a binder resin A15 was obtained. Table 1 shows the peak molecular weight, softening point, and glass transition temperature of the resultant binder resin A15.

Production Example of Low-Molecular Weight Binder Resin B1

Polyoxypropylene(2.2)-2,2-bis(4-hydroxyphenyl)propane: 71.9 parts by mass (0.20 mol: 100.0 mol % with respect to the total number of moles of a polyhydric alcohol)

Terephthalic acid: 26.8 parts by mass (0.16 mol: 96.0 mol % with respect to the total number of moles of polyvalent carboxylic acids)

Titanium tetrabutoxide (esterification catalyst): 0.5 part by mass

The above-mentioned materials were weighed and loaded into a reaction vessel provided with a cooling tube, a stirring machine, a nitrogen-introducing tube, and a thermocouple. Next, the inside of the reaction vessel was replaced with a nitrogen gas, and then a temperature in the reaction vessel was gradually increased while the materials were stirred. The materials were subjected to a reaction for 4 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure (first reaction step).

Trimellitic anhydride: 1.3 parts by mass (0.01 mol: 4.0 mol % with respect to the total number of moles of the polyvalent carboxylic acids)

Tert-butylcatechol (polymerization inhibitor): 0.1 part by mass

After that, the above-mentioned materials were added to the resultant, the pressure in the reaction vessel was reduced to 8.3 kPa, and the mixture was subjected to a reaction for 1 hour while the temperature was maintained at 180° C. Then, it was confirmed that a softening point measured in accordance with ASTM D36-86 reached a temperature shown in Table 1. After that, the reaction was stopped by reducing the temperature (second reaction step). Thus, a binder resin B1 was obtained. Table 1 shows the number-average molecular weight, softening point, and glass transition temperature of the resultant binder resin B1.

Production Example of Low-Molecular Weight Binder Resin B2

Polyoxypropylene(2.2)-2,2-bis(4-hydroxyphenyl)propane: 64.7 parts by mass (0.18 mol: 100.0 mol % with respect to the total number of moles of a polyhydric alcohol)

Terephthalic acid: 24.1 parts by mass (0.15 mol: 96.0 mol % with respect to the total number of moles of polyvalent carboxylic acids)

Titanium tetrabutoxide (esterification catalyst): 0.5 part by mass

The above-mentioned materials were weighed and loaded into a reaction vessel provided with a cooling tube, a stirring machine, a nitrogen-introducing tube, and a thermocouple. Next, the inside of the reaction vessel was replaced with a nitrogen gas, and then a temperature in the reaction vessel was gradually increased while the materials were stirred. The materials were subjected to a reaction for 2 hours while being stirred at a temperature of 200° C.

Further, a pressure in the reaction vessel was reduced to 8.3 kPa and maintained at the pressure for 1 hour. After that, the temperature was cooled to 180° C. and the pressure was returned to atmospheric pressure (first reaction step).

Acrylic acid: 0.2 part by mass

Styrene: 8.2 parts by mass

2-Ethylhexyl acrylate: 1.6 parts by mass

Dibutyl peroxide (polymerization initiator): 1.5 parts by mass

After that, the above-mentioned mixture was dropped over 1 hour through a dropping funnel and the resultant was left to stand for 1 hour (StAc conversion reaction step).

Trimellitic anhydride: 1.2 parts by mass (0.01 mol: 4.0 mol % with respect to the total number of moles of the polyvalent carboxylic acids)

Tert-butylcatechol (polymerization inhibitor): 0.1 part by mass

After that, the above-mentioned materials were added to the resultant, the pressure in the reaction vessel was reduced to 8.3 kPa, and the mixture was subjected to a reaction for 1 hour while the temperature was maintained at 160° C. Then, it was confirmed that a softening point measured in accordance with ASTM D36-86 reached a temperature shown in Table 1. After that, the reaction was stopped by reducing the temperature (second reaction step). Thus, a binder resin B2 was obtained. Table 1 shows the number-average molecular weight, softening point, and glass transition temperature of the resultant binder resin B2.

Production Example of Crystalline Polyester Resin C1

1,10-Decanediol: 46.9 parts by mass (0.27 mol: 100.0 mol % with respect to the total number of moles of a polyhydric alcohol)

Sebacic acid: 53.1 parts by mass (0.26 mol: 100.0 mol % with respect to the total number of moles of a polyvalent carboxylic acid)

The above-mentioned materials were weighed and loaded into a reaction vessel provided with a cooling tube, a stirring machine, a nitrogen-introducing tube, and a thermocouple. Next, the inside of the reaction vessel was replaced with a nitrogen gas, and then a temperature in the reaction vessel was gradually increased while the materials were stirred. The materials were subjected to a reaction for 3 hours while being stirred at a temperature of 140° C. Tin 2-ethylhexanoate: 0.5 part by mass After that, the above-mentioned material was added to the resultant, a pressure in the reaction vessel was reduced to 8.3 kPa, and the mixture was subjected to a reaction for 4 hours while the temperature was maintained at 200° C. Thus, a crystalline polyester resin 1 was obtained.

TABLE 1

| | Polyhydric alcohol component | | | | | | Polyvalent carboxylic acid component | | | | | | | | |
|---|---|---|---|---|---|---|---|---|---|---|---|---|---|---|---|
| | Used in first reaction step | | | | | | Used in first reaction step | | | | | | Used in second reaction step | | |
| | Monomer | | | Monomer | | | Monomer | | | Monomer | | | Monomer | | |
| | Kind | Number of parts by mass [part(s)] | mol % [%] | Kind | Number of parts by mass [part(s)] | mol % [%] | Kind | Number of parts by mass [part(s)] | mol % [%] | Kind | Number of parts by mass [part(s)] | mol % [%] | Kind | Number of parts by mass [part(s)] | mol % [%] |
| A1 | BPA-PO | 68.2 | 97.0 | NBP-EO | 4.4 | 3.0 | TPA | 15.0 | 55.0 | AA | 6.0 | 25.0 | Anhydrous TMA | 6.4 | 20.0 |
| A2 | BPA-PO | 68.0 | 97.0 | NBP-EO | 4.4 | 3.0 | TPA | 17.6 | 64.5 | AA | 3.7 | 15.5 | Anhydrous TMA | 6.3 | 20.0 |
| A3 | BPA-PO | 68.7 | 97.0 | NBP-EO | 4.4 | 3.0 | TPA | 9.6 | 35.0 | AA | 10.9 | 45.0 | Anhydrous TMA | 6.4 | 20.0 |
| A4 | BPA-PO | 68.0 | 97.0 | NBP-FO | 4.4 | 3.0 | TPA | 18.0 | 66.0 | AA | 3.4 | 14.0 | Anhydrous TMA | 6.3 | 20.0 |
| A5 | RPA-PO | 68.7 | 97.0 | NBP-EO | 4.4 | 3.0 | TPA | 9.4 | 34.0 | AA | 11.1 | 46.0 | Anhydrous TMA | 6.4 | 20.0 |
| A6 | BPA-PO | 67.3 | 97.0 | NBP-EO | 4.3 | 3.0 | TPA | 18.9 | 70.0 | SEA | 3.3 | 10.0 | Anhydrous TMA | 6.3 | 20.0 |
| A7 | BPA-PO | 67.0 | 97.0 | NBP-EO | 4.3 | 3.0 | TPA | 19.6 | 73.0 | TDA | 2.9 | 7.0 | Anhydrous TMA | 6.2 | 20.0 |
| A8 | BPA-PO | 67.0 | 97.0 | NBP-EO | 4.3 | 3.0 | TPA | 20.4 | 76.0 | ODA | 2.0 | 4.0 | Anhydrous TMA | 6.2 | 20.0 |
| A9 | BPA-PO | 68.5 | 97.0 | NBP-EO | 4.4 | 3.0 | TPA | 17.8 | 65.0 | FA | 2.9 | 15.0 | Anhydrous TMA | 6.4 | 20.0 |
| A10 | BPA-PO | 67.7 | 97.0 | NBP-EO | 4.3 | 3.0 | TPA | 21.7 | 80.0 | — | — | — | Anhydrous TMA | 6.3 | 20.0 |
| A11 | BPA-PO | 71.1 | 99.8 | NBP-EO | 0.3 | 0.2 | TPA | 22.2 | 80.0 | — | — | — | Anhydrous TMA | 6.4 | 20.0 |
| A12 | BPA-PO | 60.7 | 91.0 | NBP-EO | 12.5 | 9.0 | TPA | 20.8 | 80.0 | — | — | — | Anhydrous TMA | 6.0 | 20.0 |
| A13 | BPA-PO | 59.6 | 90.0 | NBP-EO | 13.8 | 10.0 | TPA | 20.6 | 80.0 | — | — | — | Anhydrous TMA | 6.0 | 20.0 |
| A14 | BPA-PO | 58.9 | 90.0 | NBP-PO | 14.9 | 10.0 | TPA | 20.3 | 80.0 | — | — | — | Anhydrous TMA | 5.9 | 20.0 |
| A15 | BPA-PO | 46.2 | 89.0 | NBP-PO | 13.0 | 11.0 | TPA | 16.1 | 80.0 | — | — | — | Anhydrous TMA | 4.7 | 20.0 |
| B1 | BPA-PO | 71.9 | 100.00 | — | — | — | TPA | 26.8 | 96.0 | — | — | — | Anhydrous TMA | 1.3 | 4.0 |
| B2 | BPA-PO | 64.7 | 100.00 | — | — | — | TPA | 24.1 | 96.0 | — | — | — | Anhydrous TMA | 1.2 | 4.0 |
| C1 | DG | 46.9 | 100.00 | — | — | — | SEA | 53.1 | 100.0 | — | — | — | — | — | — |

| | StAc component Used in hybridization reaction step | | | | | | Physical property | | | |
|---|---|---|---|---|---|---|---|---|---|---|
| | Monomer | | Monomer | | Monomer | | | | | |
| | Kind | Number of parts by mass [part(s)] | Kind | Number of parts by mass [part(s)] | Kind | Number of parts by mass [part(s)] | Mp | Mn | Tg [° C.] | Tm [° C.] |
| A1 | — | — | — | — | — | — | 13,000 | — | 60 | 145 |
| A2 | — | — | — | — | — | — | 12,500 | — | 61 | 146 |

TABLE 1-continued

| | | | | | | | | | | |
|---|---|---|---|---|---|---|---|---|---|---|
| A3 | — | — | — | — | — | — | 14,500 | — | 58 | 145 |
| A4 | — | — | — | — | — | — | 12,000 | — | 62 | 145 |
| A5 | — | — | — | — | — | — | 15,000 | — | 57 | 144 |
| A6 | — | — | — | — | — | — | 12,500 | — | 62 | 145 |
| A7 | — | — | — | — | — | — | 13,000 | — | 62 | 145 |
| A8 | — | — | — | — | — | — | 13,500 | — | 62 | 146 |
| A9 | — | — | — | — | — | — | 12,000 | — | 64 | 145 |
| A10 | — | — | — | — | — | — | 11,000 | — | 67 | 145 |
| A11 | — | — | — | — | — | — | 10,500 | — | 68 | 144 |
| A12 | — | — | — | — | — | — | 11,500 | — | 66 | 145 |
| A13 | — | — | — | — | — | — | 11,800 | — | 66 | 145 |
| A14 | — | — | — | — | — | — | 11,500 | — | 66 | 145 |
| A15 | AA (acrylic acid) | 0.5 | St | 16.4 | DEHP | 3.1 | 12,500 | — | 64 | 145 |
| B1 | — | — | — | — | — | — | — | 2,100 | 55 | 90 |
| B2 | AA (acrylic acid) | 0.2 | St | 8.2 | DEHP | 1.6 | — | 2,500 | 53 | 90 |
| C1 | — | — | — | — | — | — | 12,000 | — | — | 80 |

BPA-PO: Propylene oxide adduct of bispehnol A (average addition number of moles: 2.2 mol)
NBP-EO: Adduct of a novolac type phenol resin (having a nucleus number of about 5) with 5 mol of ethylene oxide
NBP-PO: Adduct of a novalac type phenol resin (having a nucleus number of about 5) with 5 mol of propylene oxide
DG: Decanediol
TPA: Terephthalic acid
FA: Fumaric acid
AA: Adipic acid
SEA: Sebacic acid
TDA: Tetradecanedioic acid
ODA: Octadecanedioc acid
Anhydrous TMA: Trimellitic anhydride
AA (acrylic acid): Acrylic acid
St: Styrene
DEHP: 2-Ethylhexyl acrylate Production Example of Toner 1

Binder resin A1: 30 parts by mass

Binder resin B1: 60 parts by mass

Crystalline polyester resin C1: 10 parts by mass

Fischer-Tropsch wax (peak temperature of highest endothermic peak: 78° C.): 5 parts by mass C.I. Pigment Blue 15:3: 7 parts by mass Aluminum 3,5-di-t-butylsalicylate compound (BONTRON E88, manufactured by Orient Chemical Industries Co., Ltd.): 0.3 part by mass The above-mentioned materials were mixed with a Henschel mixer (Model FM-75 manufactured by NIPPON COKE & ENGINEERING CO., LTD.) at a number of rotations of 20 $sec^{-1}$ for a time of rotation of 5 minutes, and thereafter, the mixture was kneaded with a twin screw kneader (PCM-30 manufactured by Ikegai Corp.) whose temperature was set to 130° C. The kneaded product thus obtained was cooled and coarsely pulverized with a hammer mill to 1 mm or less to provide a coarsely pulverized product. The coarsely pulverized product thus obtained was finely pulverized with a mechanical pulverizer (T-250 manufactured by FREUND-TURBO CORPORATION). Further, the finely pulverized product was classified with a Faculty F-300 (manufactured by Hosokawa Micron Corporation) to provide toner particles 1. Its operating conditions were as follows: the number of rotations of a classification rotor was set to 130 $sec^{-1}$ and the number of rotations of a dispersion rotor was set to 120 $sec^{-1}$.

1.0 Part by mass of hydrophobic silica fine particles subjected to surface treatment with 4 mass % of hexamethyldisilazane and having a BET specific surface area of 25 $m^2/g$, and 0.7 part by mass of hydrophobic silica fine particles subjected to surface treatment with 10 mass % of polydimethylsiloxane and having a BET specific surface area of 100 $m^2/g$ were added to 100 parts by mass of the resultant toner particles 1. Then, the contents were mixed with a Henschel mixer (Model FM-75 manufactured by NIPPON COKE & ENGINEERING CO., LTD.) at a number of rotations of 30 $sec^{-1}$ for a time of rotation of 10 minutes to provide a toner 1.

Production Examples of Toners 2 to 16

Toners 2 to 16 were each obtained by performing the same operations as those of the production example of the toner 1 except that in the production example of the toner 1, the binder resin A, the binder resin B, and the binder resin C were changed as shown in Table 2.

Production Example of Toner 17

A toner 17 was obtained with reference to a production method described in Example 1 of Japanese Patent Application Laid-Open No. 2006-39346.

Production Example of Toner 18

A toner 18 was obtained with reference to a production method described in Example 1 of Japanese Patent Application Laid-Open No. 2007-33828.

TABLE 2

| | Formulation | | | | | | Polyhydric alcohol component | | | | Polyvalent carboxy is acid component | | | | | |
|---|---|---|---|---|---|---|---|---|---|---|---|---|---|---|---|---|
| | Resin | Number of parts by mass [part(s)] | Resin | Number of parts by mass [part(s)] | Resin | Number of parts by mass [part(s)] | Monomer | mol % [%] | Monomer | mol % [%] | Monomer | mol % [%] | Monomer | mol % [%] | Monomer | mol % [%] |
| Toner 1 | Binder resin A1 | 60.0 | Binder resin B1 | 30.0 | Crystalline polyester resin C1 | 10.0 | BPA-PO | 99.0 | NBP-EO | 1.0 | TPA | 82.5 | AA | 8.2 | Anhydrous TMA | 9.3 |
| Toner 2 | Binder resin A2 | 60.0 | Binder resin B1 | 30.0 | Crystalline polyester resin C1 | 10.0 | BPA-PO | 99.0 | NBP-EO | 1.0 | TPA | 85.7 | AA | 5.1 | Anhydrous TMA | 9.2 |
| Toner 3 | Binder resin A3 | 60.0 | Binder resin B1 | 30.0 | Crystalline polyester resin C1 | 10.0 | BPA-PO | 99.0 | NBP-EO | 1.0 | TPA | 75.9 | AA | 14.8 | Anhydrous TMA | 9.3 |
| Toner 4 | Binder resin A4 | 60.0 | Binder resin B1 | 30.0 | Crystalline polyester resin C1 | 10.0 | BPA-PO | 99.0 | NBP-EO | 1.0 | TPA | 86.2 | AA | 4.6 | Anhydrous TMA | 9.2 |
| Toner 5 | Binder resin A5 | 60.0 | Binder resin B1 | 30.0 | Crystalline polyester resin C1 | 10.0 | BPA-PO | 99.9 | NBP-EO | 1.0 | TPA | 75.5 | AA | 15.2 | Anhydrous TMA | 9.3 |
| Toner 6 | Binder resin A6 | 60.0 | Binder resin B1 | 30.0 | Crystalline polyester resin C1 | 10.0 | BPA-PO | 99.0 | NBP-EO | 1.0 | TPA | 87.5 | SEA | 3.3 | Anhydrous TMA | 9.2 |
| Toner 7 | Binder resin A7 | 60.0 | Binder resin B1 | 30.0 | Crystalline polyester resin C1 | 10.0 | BPA-PO | 99.0 | NBP-EO | 1.0 | TPA | 88.5 | TDA | 2.3 | Anhydrous TMA | 9.2 |
| Toner 8 | Binder resin A8 | 60.0 | Binder resin B1 | 30.0 | Crystalline polyester resin C1 | 10.0 | BPA-PO | 99.0 | NBP-EO | 1.0 | TPA | 89.5 | ODA | 1.3 | Anhydrous TMA | 9.2 |
| Toner 9 | Binder resin A9 | 60.0 | Binder resin B1 | 30.0 | Crystalline polyester resin C1 | 10.0 | BPA-PO | 99.0 | NBP-EO | 1.0 | TPA | 85.8 | FA | 4.9 | Anhydrous TMA | 9.3 |
| Toner 10 | Binder resin A10 | 60.0 | Binder resin B1 | 30.0 | Crystalline polyester resin C1 | 10.0 | BPA-PO | 99.0 | NBP-EO | 1.0 | TPA | 90.8 | — | — | Anhydrous TMA | 9.2 |
| Toner 11 | Binder resin A11 | 60.0 | Binder resin B1 | 30.0 | Crystalline polyester resin C1 | 10.0 | BPA-PO | 99.0 | NBP-EO | 0.1 | TPA | 90.7 | — | — | Anhydrous TMA | 9.3 |
| Toner 12 | Binder resin A12 | 60.0 | Binder resin B1 | 30.0 | Crystalline polyester resin C1 | 10.0 | BPA-PO | 97.1 | NBP-EO | 2.9 | TPA | 90.9 | — | — | Anhydrous TMA | 9.1 |

TABLE 2-continued

| | Formulation | | | | | | Polyhydric alcohol component | | | | Polyvalent carboxy is acid component | | | | | |
|---|---|---|---|---|---|---|---|---|---|---|---|---|---|---|---|---|
| | Resin | Number of parts by mass [part(s)] | Resin | Number of parts by mass [part(s)] | Resin | Number of parts by mass [part(s)] | Mono-mer | mol % [%] | Mono-mer | mol % [%] | Mono-mer | mol % [%] | Mono-mer | mol % [%] | Mono-mer | mol % [%] |
| Toner 13 | Binder resin A13 | 60.0 | Binder resin B1 | 30.0 | Crystalline polyester resin C1 | 10.0 | BPA-PO | 96.8 | NBP-EO | 3.2 | TPA | 91.0 | — | — | Anhy-drous TMA | 9.0 |
| Toner 14 | Binder resin A14 | 60.0 | Binder resin B1 | 30.0 | Crystalline polyester resin C1 | 10.0 | BPA-PO | 96.8 | NBP-EO | 3.2 | TPA | 91.0 | — | — | Anhy-drous TMA | 9.0 |
| Toner 15 | Binder resin A15 | 60.0 | Binder resin B1 | 30.0 | Crystalline polyester resin C1 | 10.0 | BPA-PO | 96.9 | NBP-EO | 3.1 | TPA | 91.4 | — | — | Anhy-drous TMA | 8.6 |
| Toner 16 | Binder resin A13 | 70.0 | Binder resin B1 | 30.0 | — | — | BPA-PO | 96.8 | NBP-EO | 3.2 | TPA | 91.0 | — | — | Anhy-drous TMA | 9.0 |

BPA-PO: Propylene oxide adduct of bisphenol A (average addition number of moles: 2.2 mol)
NBP-EO: Adduct of a novolac type phenol resin (having a nucleus number of about 5) with 5 mol of ethylene oxide
NBP-PO: Adduct of a novolac type phenol resin (having a nucleus number of about 5) with 5 mol of propylene oxide
DG: Decanediol
TPA: Terephthalic acid
FA: Fumaric acid
AA: Adipic acid
SEA: Sebacic acid
TDA: Tetradecanedioic acid
ODA: Octadecanedioic acid
Anhydrous TMA: Trimellitic anhydride
AA (acrylic acid): Acrylic acid
St: Styrene
DEHP: 2-Ethylhexyl acrylate Production Example of Magnetic Core Particles 1

Step 1 (Weighing/Mixing Step)

$Fe_2O_3$: 62.7 parts by mass
$MnCO_3$: 29.5 parts by mass
$Mg(OH)_2$: 6.8 parts by mass
$SrCO_3$: 1.0 part by mass Ferrite raw materials were weighed so that the above-mentioned had the above-mentioned composition ratio. After that, the materials were pulverized and mixed with a dry vibrating mill using stainless-steel beads each having a diameter of ⅛ inch for 5 hours.

Step 2 (Pre-Calcining Step)

The resultant pulverized product was turned into a square pellet 1 mm on a side with a roller compacter. Coarse powder was removed from the pellet with a vibrating sieve having an aperture of 3 mm. Then, fine powder was removed therefrom with a vibrating sieve having an aperture of 0.5 mm. After that, the remainder was calcined under a nitrogen atmosphere (oxygen concentration: 0.01 vol %) with a burner type calcining furnace at a temperature of 1,000° C. for 4 hours to produce a pre-calcined ferrite. The composition of the resultant pre-calcined ferrite is as described below.

$$(MnO)_a(MgO)_b(SrO)_c(Fe_2O_3)_d$$

In the compositional formula, a=0.257, b=0.117, c=0.007, d=0.393.

Step 3 (Pulverizing Step)

The pre-calcined ferrite was pulverized with a crusher into pieces each having a size of about 0.3 mm. After that, 30 parts by mass of water with respect to 100 parts by mass of the pre-calcined ferrite were added to the pieces, and then the mixture was pulverized with a wet ball mill using zirconia beads each having a diameter of ⅛ inch for 1 hour. The resultant slurry was pulverized with a wet ball mill using alumina beads each having a diameter of 1/16 inch for 4 hours. Thus, a ferrite slurry (finely pulverized product of the pre-calcined ferrite) was obtained.

Step 4 (Granulating Step)

1.0 Part by mass of ammonium polycarboxylate as a dispersant and 2.0 parts by mass of polyvinyl alcohol as a binder resin with respect to 100 parts by mass of the pre-calcined ferrite were added to the ferrite slurry, and then the mixture was granulated into spherical particles with a spray drier (manufacturer: OHKAWARA KAKOHKI CO., LTD.). The particle sizes of the resultant particles were adjusted, and then the dispersant and the binder resin as organic components were removed by heating the particles with a rotary kiln at 650° C. for 2 hours.

Step 5 (Calcining Step)

In order for a calcining atmosphere to be controlled, the temperature of the remainder was increased from room temperature to a temperature of 1,300° C. in an electric furnace under a nitrogen atmosphere (having an oxygen concentration of 1.00 vol %) in 2 hours, and then the remainder was calcined at a temperature of 1,150° C. for 4 hours. After that, the temperature of the calcined product was decreased to a temperature of 60° C. over 4 hours and the nitrogen atmosphere was returned to the air. When its temperature became 40° C. or less, the calcined product was taken out.

Step 6 (Sorting Step)

After an agglomerated particle had been shredded, a low-magnetic force product was discarded by magnetic separation, and coarse particles were removed by sieving with a sieve having an aperture of 250 μm. Thus, magnetic core particles 1 having a 50% particle diameter (D50) on a volume distribution basis of 37.0 μm were obtained.

<Preparation of Coating Resin 1>

Cyclohexyl methacrylate monomer: 26.8 mass %
Methyl methacrylate monomer: 0.2 mass %

Methyl methacrylate macromonomer: 8.4 mass % (a macromonomer having a methacryloyl group at one terminal and having a weight-average molecular weight of 5,000)
Toluene: 31.3 mass %
Methyl ethyl ketone: 31.3 mass %
Azobisisobutyronitrile: 2.0 mass %

Of the above-mentioned materials, cyclohexyl methacrylate, methyl methacrylate, the methyl methacrylate macromonomer, toluene, and methyl ethyl ketone were added to a four-necked separable flask mounted with a reflux condenser, a temperature gauge, a nitrogen-introducing tube, and a stirring apparatus. Then, a nitrogen gas was introduced into the flask to sufficiently replace the air in the flask with a nitrogen atmosphere. After that, the temperature of the mixture was increased to 80° C., azobisisobutyronitrile was added to the mixture, and the whole was polymerized by being refluxed for 5 hours. Hexane was injected into the resultant reaction product to precipitate and deposit a copolymer, and then the precipitate was separated by filtration. After that, the precipitate was vacuum-dried to provide a coating resin 1. Parts by mass of the resultant coating resin 1 were dissolved in 40 parts by mass of toluene and 30 parts by mass of methyl ethyl ketone. Thus, a polymer solution 1 (solid content: 30 mass %) was obtained.

<Preparation of Coating Resin Solution 1>
Polymer solution 1 (resin solid content concentration: 30%): 33.3 mass %
Toluene: 66.4 mass %
Carbon black (primary particle diameter: 25 nm, nitrogen adsorption specific surface area: 94 $m^2/g$, DBP oil absorption: 75 mL/100 g) (Regal 330: manufactured by Cabot Corporation): 0.3 mass %

The above-mentioned materials were dispersed with a paint shaker using zirconia beads each having a diameter of 0.5 mm for 1 hour. The resultant dispersion was filtered through a 5.0-μm membrane filter. Thus, a coating resin solution 1 was obtained.

Production Example of Magnetic Carrier 1
(Resin Coating Step)

The coating resin solution 1 was charged into a vacuum deaeration type kneader maintained at normal temperature so that its amount in terms of a resin component was 2.5 parts by mass with respect to 100 parts by mass of the filled core particles 1. After having been charged, the solution was stirred at a rotational speed of 30 rpm for 15 minutes. After a certain amount (80 mass %) or more of the solvent had been volatilized, the temperature in the kneader was increased to 80° C. while the remaining contents were mixed under reduced pressure. Toluene was removed by distillation over 2 hours and then the residue was cooled. A low-magnetic force product was separated from the resultant magnetic carrier by magnetic separation and then the remainder was passed through a sieve having an aperture of 70 μm. After that, the resultant was classified with an air classifier. Thus, a magnetic carrier 1 having a 50% particle diameter (D50) on a volume distribution basis of 38.2 μm was obtained.

Production Example of Two-Component Developer 1

8.0 Parts by mass of the toner 1 were added to 92.0 parts by mass of the magnetic carrier 1, and the contents were mixed with a V-type mixer (V-20 manufactured by SEISHIN ENTERPRISE CO., LTD.) to provide a two-component developer 1.

Production Examples of Two-Component Developers 2 to 19

Two-component developers 2 to 19 were each obtained by performing the same operations as those of the production example of the two-component developer 1 except that, in the production example of the two-component developer 1, changes were made as shown in Table 3.

TABLE 3

| | Two-component developer | Magnetic carrier | Toner |
|---|---|---|---|
| Example 1 | 1 | 1 | 1 |
| Example 2 | 2 | 1 | 2 |
| Example 3 | 3 | 1 | 3 |
| Example 4 | 4 | 1 | 4 |
| Example 5 | 5 | 1 | 5 |
| Example 6 | 6 | 1 | 6 |
| Example 7 | 7 | 1 | 7 |
| Example 8 | 8 | 1 | 8 |
| Example 9 | 9 | 1 | 9 |
| Example 10 | 10 | 1 | 10 |
| Example 11 | 11 | 1 | 11 |
| Example 12 | 12 | 1 | 12 |
| Example 13 | 13 | 1 | 13 |
| Example 14 | 14 | 1 | 14 |
| Example 15 | 15 | 1 | 15 |
| Comparative Example 1 | 16 | 1 | 16 |
| Comparative Example 2 | 17 | 1 | 17 |
| Comparative Example 3 | 18 | 1 | 18 |

Example 1

A reconstructed apparatus of a printer for digital commercial printing "imageRUNNER ADVANCE C9075 PRO" (trade name) manufactured by Canon Inc. was used as an image-forming apparatus. The two-component developer 1 was charged into a developing unit for cyan of the image-forming apparatus, and an image was formed so as to achieve a desired toner laid-on level on paper and subjected to evaluations to be described below. The printer was reconstructed so that its fixation temperature and process speed could be freely set.

Evaluations were performed based on the following evaluation methods. Table 4 shows the results of the evaluations.

(Hot Offset Resistance)
Paper: CS-680 (68.0 $g/m^2$) (sold by Canon Marketing Japan Inc.)
Toner laid-on level: 0.08 $mg/cm^2$
Fixation test environment: A normal-temperature and low-humidity environment having a temperature of 23° C. and a humidity of 5% RH (hereinafter referred to as "N/L")

After the unfixed image had been produced, the process speed was set to 450 mm/sec, the fixation temperature was increased from 150° C. in increments of 5° C., and an evaluation for hot offset resistance was performed. A procedure for the evaluation is as described below. First, 10 plain postcards were passed and then the unfixed image was passed. A value for fogging was used as an indicator of the evaluation for hot offset resistance. The fogging was calculated from the following equation by measuring an average reflectance Dr (%) of evaluation paper before image output and a reflectance Ds (%) of a white portion after a fixation test with a reflectometer ("REFLECTOMETER MODEL TC-6DS" manufactured by Tokyo Denshoku CO., LTD.). The resultant fogging was evaluated in accordance with the following evaluation criteria.

$$\text{Fogging}(\%)=Dr(\%)-Ds(\%)$$

(Evaluation Criteria)

A: Less than 0.2% (The effect is extremely excellent.)

B: From 0.2% or more to less than 0.5% (A good effect is obtained.)

C: From 0.5% or more to less than 1.0% (It is judged that the effect of the present invention is obtained.)

D: 1.0% or more (It is judged that the effect of the present invention is not obtained.)

(Low-Temperature Fixability)

Paper: CS-680 (68.0 g/m$^2$) (sold by Canon Marketing Japan Inc.)

Toner laid-on level: 1.20 mg/cm$^2$

Fixation test environment: A low-temperature and low-humidity environment having a temperature of 15° C. and a humidity of 10% RH (hereinafter referred to as "L/L")

After the unfixed image had been produced, the process speed and the fixation temperature were set to 450 mm/sec and 130° C., respectively, and an evaluation for low-temperature fixability was performed. A value for an image density reduction ratio was used as an indicator of the evaluation for low-temperature fixability. The image density reduction ratio was measured as described below. First, the image density of a central portion was measured with an X-Rite Color Reflection Densitometer (500 Series: manufactured by X-Rite). Next, a load of 4.9 kPa (50 g/cm$^2$) was applied to the portion whose image density had been measured, the fixed image was rubbed with lens-cleaning paper (5 reciprocations), and the image density was measured again. Then, the ratio (%) at which the image density reduced after the rubbing as compared with that before the rubbing was measured.

(Evaluation Criteria)

A: The density reduction ratio is less than 1.0% (the effect is extremely excellent).

B: The density reduction ratio is from 1.0% or more to less than 5.0% (a good effect is obtained).

C: The density reduction ratio is from 5.0% or more to less than 10.0% (it is judged that the effect of the present invention is obtained).

D: The density reduction ratio is 10.0% or more (it is judged that the effect of the present invention is not obtained).

(Storage Stability)

5 Grams of the toner were loaded into a 100-cc plastic cup, and were left to stand in a temperature- and humidity-variable thermostat (at 55° C. and 41%) for 48 hours. After the standing, the toner was evaluated for its agglomeration property. Used as an indicator of the evaluation for the agglomeration property was the residual ratio of the toner remaining after sieving in a Powder Tester PT-X manufactured by Hosokawa Micron Corporation with a mesh having an aperture of 20 μm at an amplitude of 0.5 mm for 10 seconds.

(Evaluation Criteria)

A: The residual ratio is less than 2.0% (the effect is extremely excellent).

B: The residual ratio is from 2.0% or more to less than 10.0% (a good effect is obtained).

C: The residual ratio is from 10.0% or more to less than 15.0% (it is judged that the effect of the present invention is obtained).

D: The residual ratio is 15.0% or more (it is judged that the effect of the present invention is not obtained).

Examples 2 to 15 and Comparative Examples 1 to 4

Evaluations were performed in the same manner as in Example 1 except that the two-component developers 2 to 19 were used. Table 4 shows the results of the evaluations.

TABLE 4

| | Hot offset resistance [%] | | Low-temperature fixability [%] | | Storage stability [%] | |
|---|---|---|---|---|---|---|
| Example 1 | A | 0.1 | A | 0.5 | A | 2 |
| Example 2 | A | 0.1 | B | 2.3 | A | 2 |
| Example 3 | A | 0.1 | B | 4.5 | A | 2 |
| Example 4 | A | 0.1 | C | 6.2 | A | 2 |
| Example 5 | A | 0.1 | C | 7.8 | A | 2 |
| Example 6 | A | 0.1 | C | 8.2 | A | 4 |
| Example 7 | A | 0.1 | C | 7.9 | B | 5 |
| Example 8 | A | 0.1 | C | 8.5 | B | 8 |
| Example 9 | A | 0.1 | C | 8.0 | B | 10 |
| Example 10 | A | 0.1 | C | 7.4 | B | 12 |
| Example 11 | B | 0.4 | C | 7.2 | B | 12 |
| Example 12 | B | 0.4 | C | 8.5 | B | 12 |
| Example 13 | C | 0.5 | C | 9.0 | B | 12 |
| Example 14 | C | 0.6 | C | 8.8 | B | 14 |
| Example 15 | C | 0.8 | C | 8.1 | B | 15 |
| Comparative Example 1 | D | 1.1 | D | 15.4 | C | 15 |
| Comparative Example 2 | D | 1.0 | C | 8.2 | C | 15 |
| Comparative Example 3 | D | 1.1 | C | 9.8 | C | 12 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-263779, filed Dec. 20, 2013, which is hereby incorporated by reference herein in its entirety.

What is claimed is:

1. A toner comprising toner particles each comprising:

a binder resin containing a polyester α as a main component thereof, said polyester α comprising a polyvalent carboxylic acid unit and a polyhydric alcohol unit comprising a polyhydric alcohol unit N derived from an alkylene oxide adduct of a novolac type phenol resin;

a colorant;

a wax; and a crystalline polyester obtained by subjecting a monomer composition to a condensation polymerization reaction, the monomer composition comprising (i) a monovalent carboxylic acid monomer, (ii) an aliphatic diol having 2 to 22 carbon atoms, and (iii) an aliphatic dicarboxylic acid having 2 to 22 carbon atoms, wherein the polyester α comprises 0.1 to 3.0 mol % of the polyhydric alcohol unit N with respect to a total number of moles of the polyhydric alcohol unit.

2. The toner according to claim 1, wherein the polyhydric alcohol unit N comprises a polyhydric alcohol unit derived from a polyhydric alcohol represented by the following formula (N):

(N)

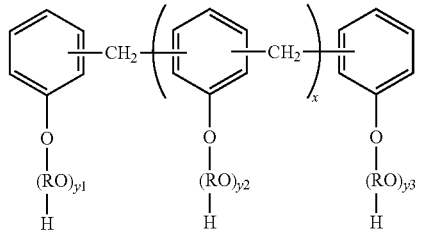

where R's each independently represent an ethylene group or a propylene group, x represents a number of 0 or more, and y1 to y3 each independently represent a number of 0 or more.

3. The toner according to claim 1, wherein the polyester α comprises, as the polyvalent carboxylic acid unit, a polyvalent carboxylic acid unit F derived from an aliphatic dicarboxylic acid containing a straight-chain hydrocarbon having 4 to 16 carbon atoms as a main chain, the aliphatic dicarboxylic acid having carboxy groups bonded to both terminals of the main chain.

4. The toner according to claim 3, wherein the polyester α comprises 5.0 to 15.0 mol % of the polyvalent carboxylic acid unit F with respect to a total number of moles of the polyvalent carboxylic acid unit.

5. A two-component developer comprising:

the toner according to claim 1; and a magnetic carrier.

6. The two-component developer according to claim 5, wherein a content of the toner in the two-component developer is from 2 to 15 mass % with respect to a total mass of the two-component developer.

* * * * *